US008068765B2

(12) United States Patent
Kagawa

(10) Patent No.: US 8,068,765 B2
(45) Date of Patent: Nov. 29, 2011

(54) FIXING DEVICE AND IMAGE FORMING APPARATUS INCLUDING THE SAME

(75) Inventor: Toshiaki Kagawa, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 419 days.

(21) Appl. No.: 12/351,919

(22) Filed: Jan. 12, 2009

(65) Prior Publication Data

US 2009/0180821 A1 Jul. 16, 2009

(30) Foreign Application Priority Data

Jan. 15, 2008 (JP) ..... 2008-006214

(51) Int. Cl.

| | |
|---|---|
| ***G03G 15/00*** | (2006.01) |
| ***G03G 15/16*** | (2006.01) |
| ***G03G 15/20*** | (2006.01) |
| ***H05B 1/00*** | (2006.01) |

(52) U.S. Cl. ..... 399/122; 399/107; 399/110; 399/328; 399/329; 399/330; 219/216

(58) Field of Classification Search ..... 399/122, 399/107, 110, 328–330; 219/216
See application file for complete search history.

(56) References Cited

U.S. PATENT DOCUMENTS

| | | | | |
|---|---|---|---|---|
| 6,243,559 | B1 | 6/2001 | Kurotaka et al. | |
| 6,871,039 | B2 * | 3/2005 | Murata | 399/323 |
| 7,200,355 | B2 * | 4/2007 | Uchiyama et al. | 399/333 |
| 7,620,336 | B2 * | 11/2009 | Yura et al. | 399/67 |
| 2005/0254846 | A1 | 11/2005 | Yura et al. | |
| 2007/0280757 | A1 | 12/2007 | Kimura | |

FOREIGN PATENT DOCUMENTS

| | | |
|---|---|---|
| JP | 2002-333788 | 11/2002 |
| JP | 2004-045951 A | 2/2004 |
| JP | 2005-326524 A | 11/2005 |
| JP | 2006-293051 | 10/2006 |
| JP | 2007-226024 A | 9/2007 |
| JP | 2007-322888 A | 12/2007 |

* cited by examiner

*Primary Examiner* — David Porta
*Assistant Examiner* — Mindy Vu
(74) *Attorney, Agent, or Firm* — Renner, Otto, Boisselle & Sklar, LLP

(57) ABSTRACT

A fixing device of the present invention is arranged so that: (i) at least both ends of a planar heat-generating member come close to or touch an outer surface of a fixing roller, said both ends being in a circumferential direction when viewed in an axial direction of the fixing roller; and (ii) the planar heat-generating member has, in the vicinity of both the ends, shapes formed gently with respect to the outer surface of the fixing roller when viewed in the axial direction. An almost whole inner surface area of the fixing belt wound around the planar heat-generating member and the fixing roller touches the planar heat-generating member or the fixing roller. The fixing belt is naturally formed, without being distorted at an area where the fixing belt touches the heating member. This allows a fixing device using a planar heat-generating belt type fixing method, which provides a short warm-up time, to be excellent in heat efficiency, consume less power, and have a fixing belt which does not slip easily.

9 Claims, 7 Drawing Sheets

FIXING DEVICE AND IMAGE FORMING APPARATUS INCLUDING THE SAME

This Nonprovisional application claims priority under 35 U.S.C. §119(a) on Patent Application No. 006214/2008 filed in Japan on Jan. 15, 2008, the entire contents of which are hereby incorporated by reference.

FIELD OF THE INVENTION

The present invention relates to (I) a fixing device which is included in an image forming apparatus using an electrophotographic printing method and (II) an image forming apparatus including the fixing device.

BACKGROUND OF THE INVENTION

As a fixing device used in an image forming apparatus (e.g., a copying machine and a printer) using an electrophotographic printing method, a fixing device using a heat-roller fixing method is widely used. The fixing device using the heat-roller fixing method includes a pair of rollers (a fixing roller and a pressure roller) which press each other. Further, both or either one of the pair of rollers internally includes heating means containing a halogen heater or the like. The fixing device fixes a toner image on a recording sheet in the following manner. The heating means heats the pair of rollers to a predetermined temperature (fixing temperature). After that, a recording sheet on which an unfixed toner image is formed is carried to a pressure area (a fixing nip area) between the pair of rollers, and then the recording sheet passes through the pressure area. Thus, the toner image is fixed on the recording sheet due to heat and pressure applied thereto.

In general, a fixing device included in a color image forming apparatus uses an elastic roller. The elastic roller is a fixing roller having an elastic layer which is provided as a surface layer and is made of silicon rubber or the like. The elastic roller is used as the fixing roller, so that a surface of the fixing roller elastically deforms according to an uneven surface of an unfixed toner image and is in contact with the toner image so as to cover the toner image. This allows a color unfixed toner image whose toner amount is larger than that of a monochrome unfixed toner image to be favorably fixed.

Further, due to strain release of the elastic layer which occurs in a fixing nip area, it is possible to improve a releasing property with respect to color toner, which is more likely to offset than monochrome toner.

Furthermore, the fixing nip area has a nip shape protruding upward (i.e., toward the fixing roller side), that is, a so-called inverse nip shape. This makes it possible to more favorably separate a sheet from the fixing roller, thereby allowing the sheet to be separated without using any separation means such as a separation claw (self-stripping). This prevents insufficient image formation which is caused by the separation means.

In order to realize a higher processing speed, the color fixing device having the foregoing arrangement is required to have a greater nip width in the fixing nip area. As means for increasing a nip width, two methods are possible. One is a method for increasing a thickness of the elastic layer of the fixing roller, and the other is a method for increasing a diameter of the fixing roller.

Increasing the thickness of the elastic layer, however, causes the following problem: In a case where the fixing roller internally includes the heating means as in a conventional arrangement, the fixing roller including the elastic layer having an increased thickness does not increase its temperature according to an increased processing speed, because the elastic layer has a very low heat conductivity. Further, increasing the diameter of the fixing roller causes such a problem that (i) warm-up time is extended and (ii) much power is consumed.

In order to solve these problems, in recent years, a belt type fixing method as disclosed in Patent Document 1 is more and more used in the color fixing device. In the belt type fixing method, a fixing belt is provided between a fixing roller and a pressure roller so that the fixing roller and the pressure roller press each other via the fixing belt.

The belt type fixing device provides a short warm-up time, because the fixing belt having a small heat capacity is heated in the belt type fixing device. Further, with the belt type fixing device, it is not necessary to integrate a heating source such as a halogen lamp into the fixing roller. This makes it possible to increase a thickness of a low-hardness elastic layer made of sponge rubber and/or the like, thereby securing a large nip width.

As the belt type fixing method, Patent Document 2 discloses a fixing device (of a planar heat-generating belt type fixing method) having a planar heat-generating body as the heating means. In the planar heat-generating belt type fixing method, the heating means has a heat capacity smaller than that of a conventional heating roller. Further, the planar heat-generating body, which is the heating means, directly generates heat. This allows the fixing device to have improved heat responsiveness, compared with a conventional method in which a heating roller is heated indirectly by means of a halogen lamp. Thereby, the fixing device attains (i) a further reduction in the warm-up time and (ii) further energy saving.

[Patent Document 1]

Japanese Unexamined Patent Application Publication, Tokukaihei, No. 10-307496

[Patent Document 2]

Japanese Unexamined Patent Application Publication, Tokukai, No. 2002-333788

These fixing devices using the conventional planar heat-generating belt type fixing method, however, have the following problems.

In the arrangement of Patent Document 2, a shape of the fixing belt wound around the fixing roller is deformed at an area where the fixing belt is in contact with a heating member. This is because of the following reason: (i) The heating member, whose external shape is a substantially semicircle when viewed in an axial direction, is provided so as to be far from the fixing roller. (ii) A curvature radius of the heating member is larger than a radius of the fixing member. (iii) A width of the heating member is larger than a diameter of the fixing roller.

Therefore, the arrangement of Patent Document 2 has a problem with heat efficiency. The problem is caused as follows: Heat is emitted, to atmosphere, from an inner surface area of the fixing belt which area is not in contact with the planar heat-generating body or the fixing roller, and thereby the heat efficiency is decreased. Further, the arrangement of Patent Document 2 has a problem of slippage of the fixing belt. The problem is caused as follows: the deformed shape of the fixing belt wound around the fixing roller causes friction force to be applied to the fixing belt when the fixing belt slides on the heating member, and thereby the fixing belt becomes more prone to slip.

Further, during a stand-by mode in which the fixing roller does not rotate, pre-heating of the fixing belt is carried out only in an area where the fixing belt is in contact with the heating member. Therefore, when printing operation is started immediately after the stand-by mode, heat of the fixing belt is rapidly taken away by the fixing roller, and thereby a degree of undershooting is increased. As a result, it takes time for restoring a temperature of the fixing belt to a value which allows a toner image to be fixed. This arises such a problem that FCOT (First Copy Output Time) is extended.

Patent Document 2 describes that providing the heating member in the vicinity of the fixing roller reduces heat loss caused by the heat dissipation and improves belt running performance. However, with the arrangement where the heating member is provided so as to be far from the fixing roller, it is impossible to sufficiently reduce the heat loss and thereby to improve the belt running performance. Further, Patent Document 2 also describes that providing the heating member in the vicinity of the fixing roller allows the fixing roller to be heated by radiant heat and convection. However, with the arrangement where the heating member provided so as to be far from the fixing roller, it is impossible to sufficiently preheat a fixing roller having a large heat capacity.

SUMMARY OF THE INVENTION

A first object of the present invention is to provide (I) a fixing device (i) using a planar heat-generating belt type fixing method, which provides a short warm-up time, and (ii) being arranged so as to be excellent in heat efficiency, to consume less power, and not to allow a fixing belt to slip easily, and (II) an image forming apparatus including the fixing device. A second object of the present invention is to provide (I) the fixing device arranged so as to shorten first copy output time and (II) an image forming apparatus including the fixing device.

In order to attain the first object, (I) a fixing device according to the present invention and (II) an image forming apparatus including the fixing device each include: (i) a fixing section including a fixing roller; a heating member which is curved and is made out of a planar heat-generating body; and a fixing belt which is endless and is wound around an outer surface of the fixing roller and an outer surface of the heating member; and (ii) a pressure section, provided so as to face the fixing roller in the fixing section via the fixing belt, for pressing the fixing roller, the heating member being arranged so that at least both ends of the heating member are in the vicinity of or in contact with the outer surface of the fixing roller, said both ends being in a circumferential direction when viewed in an axial direction of the fixing roller, and the heating member having, in the vicinity of said both ends, shapes formed gently with respect to the outer surface of the fixing roller when it is viewed in the axial direction.

According to the arrangement, an almost whole inner surface area of the fixing belt wound around the heating member and the fixing roller is in contact with the heating member or the fixing roller. This makes it possible for the fixing belt to be arranged so as to have no area or almost no area exposed to atmosphere. This prevents or reduces as much as possible the heat loss caused by the heat dissipation to the air from the inner surface of the fixing belt, thereby improving the heat efficiency.

Specifically, it is most preferable that 100% of the inner surface area of the fixing belt is in contact with the heating member or the fixing roller. However, with an arrangement where at least 80% of the inner surface area of the fixing belt is in contact with the heating member or the fixing roller, it is possible to enhance the heat efficiency compared with a conventional arrangement.

Further, the fixing belt is naturally formed, without being distorted at an area where the fixing belt is in contact with the heating member. This reduces a sliding load applied on the fixing belt, thereby suppressing an occurrence of slippage of the fixing belt.

With this, in the fixing device using the planar heat-generating belt type fixing method, which provides the short warm-up time, it is possible to obtain the following effects: excellent heat efficiency; less power consumption; a fixing belt which does not slip easily; and the like.

Further, (I) the fixing device according to the present invention and (II) the image forming apparatus including the fixing device may be arranged so as to further include a pressure release mechanism for releasing pressure applied by the pressure section, wherein: (i) the pressure release mechanism releases the pressure applied by the pressure section and (ii) the fixing roller is rotated so as to be pre-heated by heat generated by the heating member, during a stand-by state.

According to the arrangement, the fixing roller is rotated even during the stand-by mode so as to be pre-heated uniformly by the heat generated by the heating member. Thereby, even in a case where printing operation is started immediately after the stand-by mode, it is possible to prevent heat of the fixing belt from being rapidly taken away by the fixing roller, thereby preventing an increase in a degree of undershooting. This makes it is possible to shorten FCOT (First Copy Output Time).

Further, during the stand-by mode, the fixing belt is not rotated in conjunction with the rotation of the fixing roller, because the fixing roller is rotated after the pressure applied by the pressure section is released. This also avoids such a problem that a life of the fixing belt is shortened because of sliding between the fixing belt and members such as the heating member and a temperature sensor.

Additional objects, features, and strengths of the present invention will be made clear by the description below. Further, the advantages of the present invention will be evident from the following explanation in reference to the drawings.

DESCRIPTION OF THE EMBODIMENTS

First Embodiment

Figure 1:
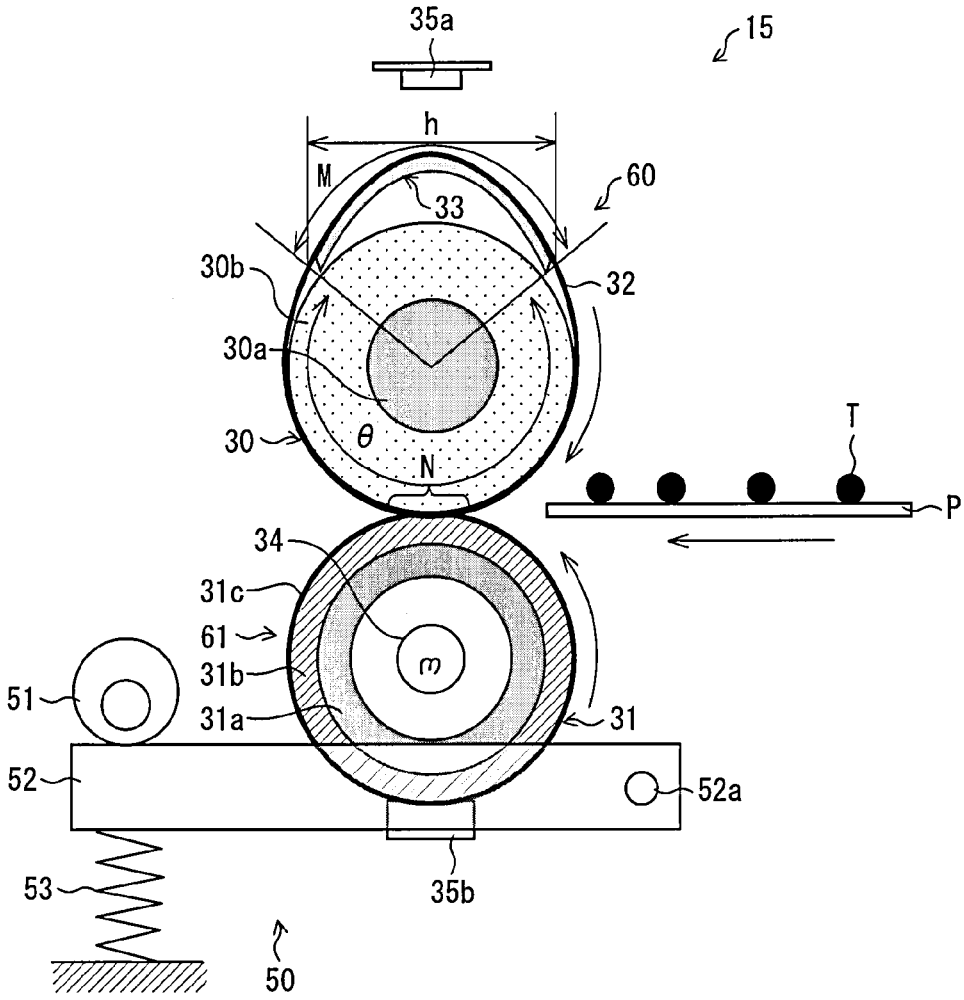
FIG. 1 illustrates one embodiment of the present invention, and is a partial cross-section view schematically illustrating an arrangement of a fixing unit included in a color multifunction peripheral, as viewed in an axial direction.
Figure 2:
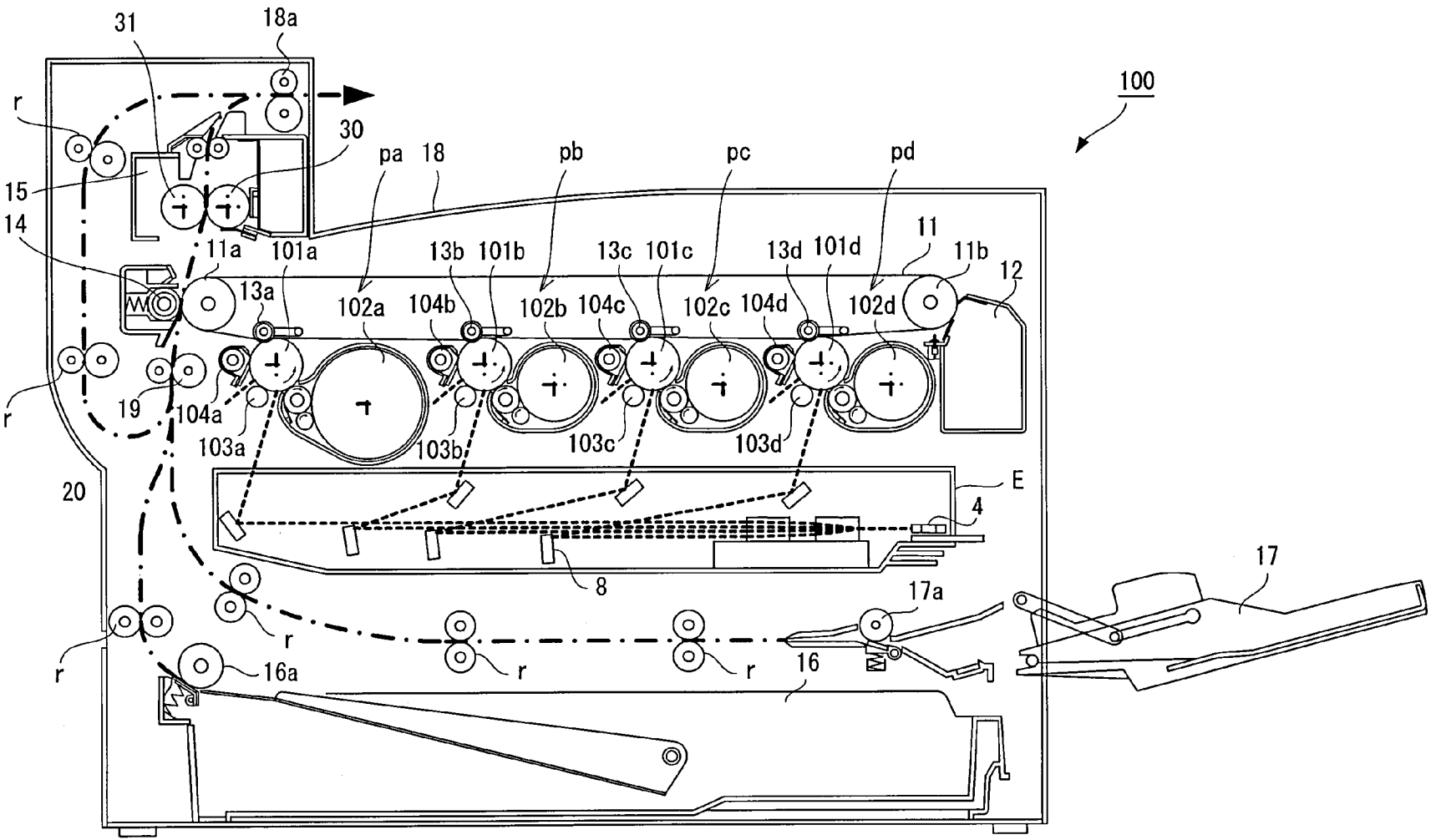
FIG. 2 is a schematic view illustrating an arrangement of the color multifunction peripheral.
Figure 3:
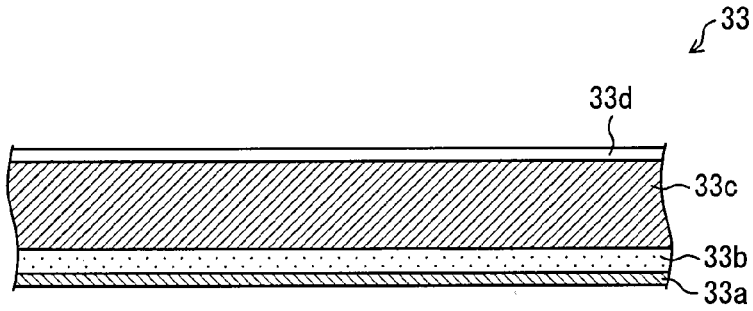
FIG. 3 is an enlarged view illustrating an arrangement of a cross-section of a heating member included in the fixing unit.
Figure 4:
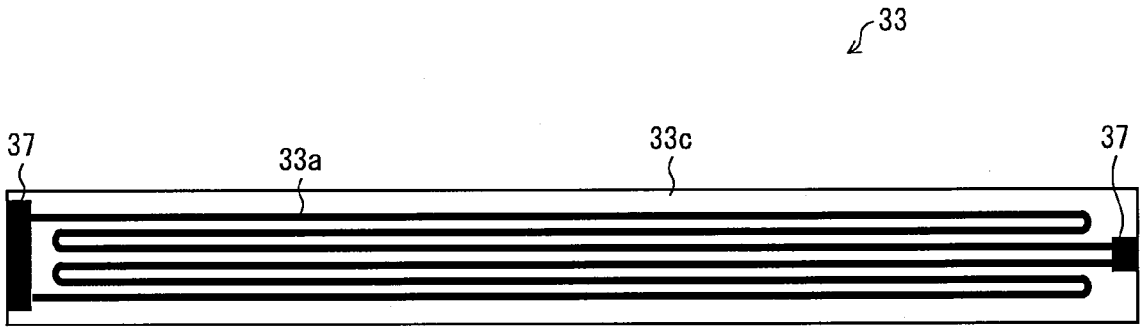
FIG. 4 is a front view of the heating member included in the fixing unit, as viewed in the axial direction.

The following describes, with reference to FIG. 1 through FIG. 4, one embodiment of the present invention. The present embodiment is arranged such that a fixing device and an image forming apparatus each of which is of the present invention are used in a color multifunction peripheral. FIG. 1 is a cross-section view illustrating an arrangement of a fixing unit (a fixing device) included in the color multifunctional peripheral, as viewed in an axial direction; FIG. 2 is a schematic view illustrating an arrangement of the color multifunction peripheral; FIG. 3 is an enlarged view illustrating an arrangement of a cross-section of a planar heat-generating member (heating member) made out of a planar heat-generating body; and FIG. 4 is a front view of a planar heat-generating member.

A color multifunction peripheral 100 according to the present embodiment includes, as illustrated in FIG. 2, an optical system unit E, four visual image forming units pa, pb, pc, and pd, an intermediate transfer belt 11, a second transfer unit 14, a fixing unit 15, an internal sheet feeding unit 16, and a manual sheet feeding unit 17.

The visual image forming unit pa includes a charging unit 103*a*, a developing unit 102*a*, and a cleaning unit 104*a*, each of which is provided around a photoreceptor drum 101*a* (i.e., a toner image bearing member). Further, a first transfer unit 13*a* is provided via the intermediate transfer belt 11. The other three visual image forming units pb, pc, and pd have a similar arrangement to that of the visual image forming unit pa. The developing units in the visual image forming units contain toner of different colors, that is, yellow (Y), magenta (M), cyan (C), and black (B), respectively.

The optical system unit E is provided so that data is transmitted from a light source 4 to the four photoreceptor drums 101*a*, 101*b*, 101*c*, and 101*d*. The intermediate transfer belt 11 is provided so that tension rollers 11*a* and 11*b* prevent the intermediate transfer belt 11 from being loosened. The tension roller 11*b* is provided with a used toner box 12 in such an arrangement that the tension roller 11*b* and the used toner box 12 are in contact with each other. The tension roller 11*a* is provided with the second transfer unit 14 in such an arrangement that the tension roller 11*a* and the second transfer unit 14 are in contact with each other.

In the fixing unit 15, a fixing roller 30 and a pressure roller 31 press each other at a predetermined pressure by means of pressure means (not illustrated). The fixing roller 30 and the pressure roller 31 are provided downstream of the second transfer unit 14. First Embodiment adopts the fixing unit 15 using a planar heat-generating belt type fixing method, which will be described in detail later.

The following describes how an image is formed. A surface of the photoreceptor drum 101*a* is uniformly charged by the charging unit 103*a*. Then, the surface of the photoreceptor drum 101*a* is subjected to laser exposure by means of the optical system unit E in accordance with image information, so that an electrostatic latent image is formed thereon. The charging unit 103*a* uses a charging roller method so as to uniformly charge the surface of the photoreceptor drum 101*a* while generation of ozone is suppressed as much as possible. After that, the developing unit 102*a* develops a toner image in accordance with the electrostatic latent image on the photoreceptor drum 101*a*. Subsequently, the toner image, which is made visible, is transferred onto the intermediate transfer belt 11 by means of the first transfer unit 13*a* to which a bias voltage having a polarity reverse to a charging polarity of the toner is applied.

The other three visual image forming units pb, pc, and pd also operate in a similar manner as described above so as to transfer toner images onto the intermediate transfer belt 11 in order. The toner image on the intermediate transfer belt 11 is carried to the second transfer unit 14. Then, another bias voltage having a polarity reverse to a charging polarity of the toner is applied to a recording sheet which is fed from (i) a sheet feeding roller 16*a* of the internal sheet feeding unit 16 or (ii) a sheet feeding roller 17*a* of the manual sheet feeding unit 17, so that the toner image is transferred onto the recording sheet. The toner image on the recording sheet is carried to the fixing unit 15. After that, while the toner image is passing through the fixing unit 15, heat and pressure is sufficiently applied thereto so that the toner image is molten and fixed on the recording sheet. Then, the recording sheet is discharged to the outside.

Next, the following describes, with reference to FIG. 1, FIG. 3, and FIG. 4, an arrangement of the fixing unit (fixing device) 15 of the present embodiment. The fixing unit 15 is for causing an unfixed toner image T formed on a surface of a recording sheet (recording material) P to be fixed on the recording paper P by using heat and pressure. The unfixed toner image T is formed by, for example, developer (toner) such as nonmagnetic single-component developer (nonmagnetic toner), nonmagnetic two-component developer (nonmagnetic toner and carrier), and magnetic developer (magnetic toner).

As illustrated in FIG. 1, the fixing unit 15 uses the planar heat-generating belt type fixing method. The fixing unit 15 includes: the fixing roller 30; a fixing belt 32 which is endless; a planar heat-generating member (heating member) 33 for supporting and heating the fixing belt 32; the pressure roller 31; a heater lamp 34 as a heat source for heating the pressure roller 31; thermistors 35*a* and 35*b* as temperature sensors constituting temperature detecting means for detecting temperatures of the fixing belt 32 and the pressure roller 31, respectively; a pressure spring 53; and a pressure releasing mechanism 50. A fixing section 60 includes the fixing roller 30, the fixing belt 32, and the planar heat-generating member 33. A pressure section 61 includes the pressure roller 31 and the heater lamp 34.

The fixing roller 30 and the pressure roller 31 press each other at a predetermined load (e.g., 216 N in First Embodiment) by means of the pressure spring 53, thereby forming a fixing nip area N (i.e., an area where a fixing roller and a pressure roller get in touch with each other) between the fixing roller 30 and the pressure roller 31. In First Embodiment, a nip width (i.e., a width of the fixing nip area N in a direction in which a recording sheet is carried) is set at 7 mm.

The recording sheet P, on which the unfixed toner image T is formed, is carried to the fixing nip area N, and then the recording sheet P is caused to pass through the fixing nip area N. Thus, the unfixed toner image T is fixed on the recording sheet P. While the recording sheet P is passing through the fixing nip area N, the fixing belt 32 gets in touch with a surface of the recording sheet P on which surface the toner image is formed, and the pressure roller 31 gets in touch with the other surface (i.e., a surface which is not the surface on which the toner image is formed) of the recording sheet P.

The fixing roller 30 is for (i) forming the fixing nip area N by pressing the pressure roller 31 via the fixing belt 32 and for (ii) driving the fixing belt 32 by rotation of the fixing roller 30. The fixing roller 30 may be, for example, the one having a two-layered construction in which a shaft 30*a* and an elastic layer 30*b* are formed in this order from the inside. The shaft 30*a* may be made of, for example, metals such as iron, stainless steel, aluminum, and copper, or an alloy made of ones selected from these metals. Further, the elastic layer 30*b* may preferably be made of rubber having heat resistance, for example, silicon rubber or fluororubber. In First Embodiment, the fixing roller 30 has: a diameter of 30 mm; the shaft

30*a* made of iron having a diameter of 15 mm; and the elastic layer 30*b* made of silicon sponge rubber having a thickness of 5 mm.

The pressure roller 31 may be, for example, the one having a three-layered construction in which a shaft 31*a*, an elastic layer 31*b*, and a releasing layer 31*c* are formed in this order from the inside. The shaft 31*a* may be made of, for example, metals such as iron, stainless steel, aluminum, and copper, or an alloy made of ones selected from these metals. Further, the elastic layer 31*b* may preferably be made of rubber having heat resistance, for example, silicon rubber or fluororubber. Furthermore, the releasing layer 31*c* may preferably be fluororesin such as PFA (tetrafluoroethylene-perfluoroalkyl vinyl ether copolymer) and PTFE (polytetrafluoroethylene). In First Embodiment, the pressure roller 31 has: a diameter of 30 mm; the shaft 31*a* made of iron (STKM) having a diameter of 24 mm and a thickness of 2 mm; the elastic layer 31*b* made of silicon solid rubber having a thickness of 3 mm; and the releasing layer 31*c* made of a PFA tube having a thickness of 30 μm.

The pressure roller 31 internally includes the heater lamp 34 for heating the pressure roller 31, the heater lamp 34 containing a halogen lamp or the like. A control circuit (not illustrated) causes a power source circuit (not illustrated) to supply power (i.e., distribute electricity) to the heater lamp 34. Thereby, the heater lamp 34 emits light so as to emit an infrared ray. Then, an inner surface of the pressure roller 31 absorbs the infrared ray and thereby is heated. Thus, the whole of the pressure roller 31 is heated. In First Embodiment, the heater lamp 34 having a rated power of 400 W is used.

The fixing belt 32 is heated to a predetermined temperature by means of the planar heat-generating member 33 so as to heat the recording sheet P, on which the unfixed toner image T is formed and which passes through the fixing nip area N. The fixing belt 32 is suspended by the planar heat-generating member 33 and the fixing roller 30, and is wound around the fixing roller 30 at a predetermined winding angle θ.

The winding angle θ indicates how much the fixing belt 32 is in contact with the fixing roller 30. The winding angle θ is made by two line segments extending from a rotational axis of the fixing roller 30 to two points at which the fixing belt 32 is separated from a surface of the fixing roller 30.

The fixing belt 32 is arranged so that at least 80% of an inner surface area of the fixing belt 32, more preferably at least 90% of the inner surface area of the fixing belt 32, or most preferably 100% of the inner surface area of the fixing belt 32 is in contact with the planar heat-generating member 33 or the fixing roller 30.

When the fixing roller 30 rotates, the fixing belt 32 is also rotated together with the fixing roller 30. The fixing belt 32 may be the one having a three-layered construction. For example, the fixing belt 32 includes (i) a hollow cylindrical substrate made of heat-resistant resin such as polyimide or metal material such as stainless steel and nickel, (ii) an elastic layer made of elastomeric material (e.g., silicon rubber), which is excellent in heat resistance and elasticity, the elastic layer being formed on a surface of the hollow cylindrical substrate, and (iii) a releasing layer made of synthetic resin material (e.g., fluororesin such as PFA and PTFE), which is excellent in heat resistance and a releasing property, the releasing layer being formed on a surface of the elastic layer. (The hollow cylindrical substrate, the elastic layer, and the releasing layer are not illustrated.) The elastomeric material and the releasing layer are formed on the outer surface side of the fixing belt 32. Further, in a case where the heat-resistant resin such as the polyimide is used as the substrate, it is preferable that fluororesin is internally added. This further reduces a sliding load applied on the fixing belt 32, the sliding load being generated when the fixing belt 32 slides on the planar heat-generating member 33.

In First Embodiment, the fixing belt 32 has: a diameter of 33 mm; a substrate made of polyimide having a thickness of 70 ∞m; an elastic layer made of silicon rubber having a thickness of 150 μm; a releasing layer made of a PFA tube having a thickness of 30 μm; and a winding angle θ of 260°.

The planar heat-generating member 33, which includes the planar heat-generating body, is for heating the fixing belt 32 to a predetermined temperature by getting in contact with the fixing belt 32. In First Embodiment, at least both ends (in a circumferential direction when viewed in the axial direction of the fixing roller) of the planar heat-generating member 33 are provided so as to be in the vicinity of or in contact with an outer surface of the fixing roller 30. Further, the planar heat-generating member 33 has, in the vicinity of both the ends, shapes formed gently with respect to the outer surface of the fixing roller 30 when it is viewed in the axial direction.

With this arrangement, an almost whole inner surface area of the fixing belt 32, which is wound around the planar heat-generating member 33 and the fixing roller 30, is in contact with the planar heat-generating member 33 or the fixing roller 30. This makes it possible for the fixing belt 32 to be arranged so as to have no area or almost no area exposed to atmosphere. This prevents or reduces as much as possible heat loss caused by heat dissipation to the air from the inner surface of the fixing belt 32, thereby improving heat efficiency. Further, with this arrangement, the fixing belt 32 may be naturally formed, without being distorted at an area where the fixing belt 32 is in contact with the planar heat-generating member 33. This reduces the sliding load applied on the fixing belt 32, thereby suppressing an occurrence of slippage of the fixing belt 32.

In the arrangement where the ends of the planar heat-generating member 33 are in contact with the fixing roller 30, it is preferable that means such as (i) applying fluororesin coating to the ends of the planar heat-generating member 33 or (ii) covering the fixing roller 30 with a fluororesin tube so that a surface layer of the fixing roller 30 is formed thereon is carried out, for the purpose of facilitating smooth driving of the fixing roller 30.

In First Embodiment, the planar heat-generating member 33 is formed so as to (i) have a width h (viewed in the axial direction) smaller than a diameter of the fixing roller 30 and (ii) be in a bullet-nose shape (viewed in the axial direction).

By making the width h (viewed in the axial direction) of the planar heat-generating member 33 smaller than a width of the fixing roller 30, it is possible for the fixing belt 32 to be wound around the fixing roller 30 at a winding angle of 180° or more. This makes it possible for the fixing roller 30 to secure a sufficient driving force for driving the fixing belt 32, thereby suppressing the occurrence of slippage of the fixing belt 32.

By forming the planar heat-generating member 33 in the bullet-nose shape, it is possible to reduce the width h (viewed in the axial direction) of the planar heat-generating member 33 and secure a wide contact width M (i.e., a dimension in a rotational direction of the fixing belt 32), in which the planar heat-generating member 33 is in contact with the fixing belt 32.

In the planar heat-generating member 33 of First Embodiment, the width h (i.e., a dimension in the direction in which a sheet is carried) is 25 mm, which is smaller than the diameter of the fixing roller 30, and the contact width M, in which the planar heat-generating member 33 is in contact with the fixing belt 32, is 36 mm. In First Embodiment, 90% of the inner surface area of the fixing belt 32 is in contact with the planar heat-generating member 33 or the fixing roller 30.

For example, the planar heat-generating member 33 may have a four-layered construction in which, as illustrated in FIG. 3, a resistive heat-generating layer 33*a*, an insulator layer 33*b*, a substrate 33*c*, and a coating layer 33*d* are formed in this order from the inside. In First Embodiment, the resistive heat-generating layer 33*a* is made of a stainless (SUS) foil having a thickness of 15 μm; the insulator layer 33*b* is made of polyimide having a thickness of 30 μm; the substrate 33*c* is made of aluminum having a thickness of 1 mm; and the coating layer 33*d* is made of PTFE (polytetrafluoroethylene) coating having a thickness of 20 μm.

As illustrated in the front view in FIG. 4, the resistive heat-generating layer 33*a* has heat-generating patterns which (i) extend, in a longitudinal direction of the planar heat-generating member 33, from power supplying sections 37 formed at both sides of the planar heat-generating member 33, respectively, and (ii) fold at every predetermined width.

For example, in First Embodiment, a line width of the heat-generating pattern is 2.4 mm, a gap between the heat-generating patterns adjacent to each other is 2.4 mm, a length at which the heat-generating pattern folds is 320 mm, and the number of the heat-generating patterns which are arranged in parallel is 6.

Further, the power supplying section 37 is connected to an AC power source (not illustrated). For example, when an AC voltage of 100 V is applied to the resistive heat-generating layer 33*a*, the resistive heat-generating layer 33*a* generates heat energy of approximately 1000 W.

Furthermore, as illustrated in FIG. 1, the thermistors 35*a* and 35*b* as the temperature detecting means are provided for the outer surfaces of the fixing belt 32 and the pressure roller 31, respectively. The thermistors 35*a* and 35*b* detect temperatures of the outer surfaces of the fixing belt 32 and the pressure roller 31, respectively. Then, in accordance with the temperature data obtained by the thermistors 35*a* and 35*b*, the control circuit (not illustrated) as temperature control means controls power supply (electricity distribution) to the planar heat-generating member 33 and the heater lamp 34 so that the surfaces of the fixing belt 32 and the pressure roller 31 obtain predetermined temperatures, respectively. In First Embodiment, the thermistor 35*a* is a non-contact type, and the thermistor 35*b* is a contact-type.

Subsequently, the recording sheet P on which the unfixed toner image T is formed is carried to the fixing nip area N at a predetermined fixing speed and at a predetermined copying speed, and then the unfixed toner image T is fixed due to heat and pressure applied thereto. The fixing speed refers to a so-called processing speed. The copying speed refers to how many sheets are copied per minute. The fixing speed and the copying speed are not particularly limited, however, the fixing speed is set at 220 mm/sec. in First Embodiment.

The fixing roller 30 is rotated by a drive motor (drive means), which is not illustrated. The fixing belt 32 and the pressure roller 31 are rotated in conjunction with the rotation of the fixing roller 30. Therefore, as illustrated in FIG. 1, rotational directions of the fixing belt 32 and the pressure roller 31 are reverse to each other. This allows the recording sheet P to pass through the fixing nip area N.

The pressure releasing mechanism 50 is for releasing pressure that the pressure roller 31 applies onto the fixing roller 30. The pressure releasing mechanism 50 includes: a pressure lever 52 supported in such an arrangement where the pressure lever 52 is freely swingable around a rotational axis 52*a*; and a separately-provided cam 51.

The pressure roller 31 has a journal above the pressure lever 52. The pressure spring 53 is provided to the pressure lever 52 on its bottom surface and on a side opposite to a side on which the rotational axis 52*a* is provided. The pressure spring 53 pushes the pressure lever 52 so that the pressure lever 52 moves toward the fixing roller 30. The pressure roller 31 applies pressure to the fixing roller 30 in this way. Further, the separately-provided cam 51 is provided to the pressure lever 52 on its top surface and on the side opposite to the side on which the rotational axis 52*a* is provided. The separately-provided cam 51 is rotated by a motor (not illustrated), thereby pushing down the pressure lever 52 so as to release the pressure applied by the pressure roller 31.

In the fixing unit 15 of First Embodiment, while the color multifunction peripheral 100 is in the stand-by mode, the pressure applied by the pressure roller 31 is released, and the pressure roller 31 is separated from the fixing roller 30. Then, the fixing roller 30 is rotated at a predetermined speed lower than the fixing speed. In First Embodiment, the fixing roller 30 is rotated at a speed of 55 mm/sec. during the stand-by mode.

The following describes the reason why the pressure roller 31 is separated from the fixing roller 30 and the fixing roller 30 is rotated during the stand-by mode.

In order to uniformly pre-heat the outer surface of the fixing roller 30 during the stand-by mode, the fixing roller 30 is required to be rotated because the planar heat-generating member 33 faces only a part of the fixing roller 30. However, in a case where the fixing roller 30 is rotated during the stand-by mode with the pressure applied by the pressure roller 31 not released, the fixing belt 32, which is provided between the fixing roller 30 and the pressure roller 31, is also rotated in conjunction with the rotation of the fixing roller 30. This causes the fixing belt 32 to slide on the pressure roller 31, the planar heat-generating member 33, a stripping claw (not illustrated), and the like, thereby shortening a life of the fixing belt 32.

In view of this, during the stand-by mode, the fixing roller 30 is rotated after the pressure applied by the pressure roller 31 is released. Releasing the pressure applied by the pressure roller 31 during the stand-by mode prevents the fixing belt 32 from slipping and being rotated in conjunction with the rotation of the fixing roller 30, thereby allowing the fixing roller 30 alone to rotate.

Thus, the fixing roller 30 is pre-heated by being rotated in this manner during the stand-by mode. Thereby, even in a case where printing operation is started immediately after the stand-by mode, it is possible to prevent heat of the fixing belt 32 from being rapidly taken away by the fixing roller 30, thereby preventing an increase in a degree of undershooting. This makes it possible to shorten FCOT (First Copy Output Time).

Second Embodiment

Figure 5:
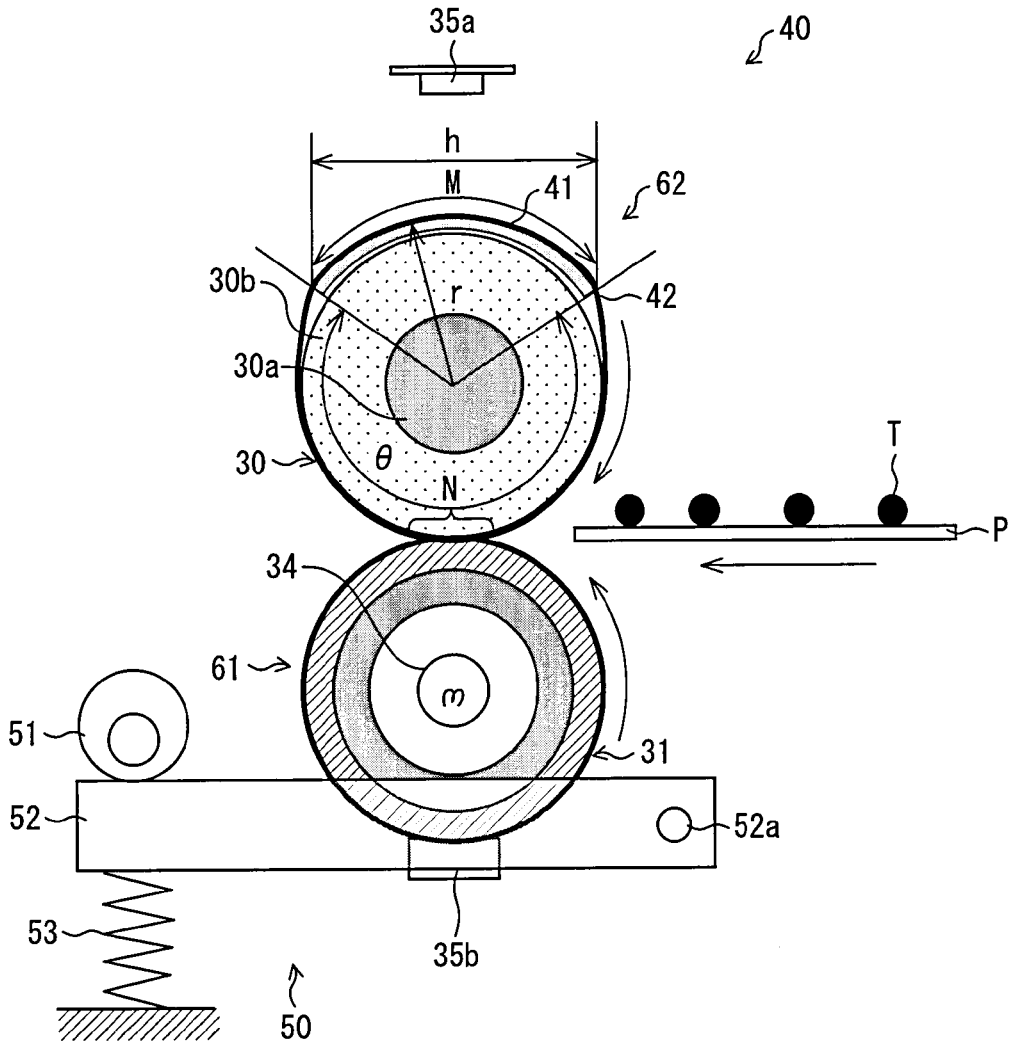
FIG. 5 illustrates another embodiment of the present invention, and is a partial cross-section view schematically illustrating an arrangement of a fixing unit included in a color multifunction peripheral, as viewed in the axial direction.

The following describes, with reference to FIG. 5, another embodiment of the present invention. A fixing unit 40 of Second Embodiment has the same structure as that of the fixing unit 15 of First Embodiment. However, the fixing unit 40 is different from the fixing unit 15 in the way that the fixing unit 40 includes a fixing section 62 instead of the fixing section 60. Therefore, for convenience of description, members having the same functions as those explained in First Embodiment are given the same signs as First Embodiment, and descriptions thereof are omitted here. Further, the description of the same structure as that explained in First Embodiment is omitted here.

As illustrated in FIG. 5, the fixing section 62 differs from the fixing section 60, in a planar heat-generating member 42 and a fixing belt 41. Except for them, the fixing section 62 has the same structure as that of the fixing section 60. As illustrated in FIG. 5, the planar heat-generating member 42 in the fixing section 62 has an arc shape so that the planar heat-generating member 42 and a fixing roller 30 are concentric, when viewed in an axial direction. Further, the planar heat-generating member 42 is provided over the fixing roller 30. Furthermore, the fixing belt 41 is provided so as to slide on the planar heat-generating member 42 while maintaining a substantially circular shape when viewed in the axial direction.

With this arrangement, as well as in the fixing unit 15 of First Embodiment, an almost whole inner surface of the fixing belt 41 wound around the planar heat-generating member 42 and the fixing roller 30 is in contact with the planar heat-generating member 42 or the fixing roller 30. Thus, the fixing belt 41 may be arranged so as to have no area or almost no area exposed to atmosphere. This prevents or reduces as much as possible heat loss caused by heat dissipation to the air from an inner surface of a fixing belt 32, thereby improving heat efficiency. Particularly, because the fixing belt 41 is formed in the substantially circular shape in Second Embodiment, it is possible to reduce a sliding load applied on the fixing belt 41, compared with in the arrangement of First Embodiment. This further suppresses an occurrence of slippage of the fixing belt 41.

In Second Embodiment, the planar heat-generating member 42 has the arc shape having a curvature radius r of 16.5 mm. Further, the planar heat-generating member 42 has a width h of 29 mm, which is smaller than a diameter of the fixing roller 30. Furthermore, the planar heat-generating member 42 is provided in the vicinity of an outer surface of an upper part of the fixing roller 30, while maintaining a gap of 0.5 mm between the planar heat-generating member 42 and the outer surface of the upper part of the fixing roller 30. Moreover, in Second Embodiment, a contact width M (i.e., a heating nip width), in which the planar heat-generating member 42 is in contact with the fixing belt 41, is 26 mm. Except for these points (the shape viewed in the axial direction, the width h, and the contact width M), the planar heat-generating member 42 has the same structure as that of the planar heat-generating member 33 of First Embodiment.

The fixing belt 41 has basically the same structure as that of the fixing belt 32. However, because the shape of the planar heat-generating member 42 is different from that of the planar heat-generating member 33, the fixing belt 41 is different in a diameter from the fixing belt 32. The fixing belt 41 of Second Embodiment has a diameter of 31 mm, which is slightly smaller than the diameter of the fixing belt 32 of First Embodiment. A winding angle θ indicating how much the fixing belt 42 is in contact with the fixing roller 30 is 260°, which is the same as that of First Embodiment. In Second Embodiment, 90% of an inner surface area of the fixing belt 41 is in contact with the planar heat-generating member 42 or the fixing roller 30.

In the arrangement illustrated in FIG. 5, the gap is provided between an inner surface of the planar heat-generating member 42 and an outer surface of the fixing roller 30. However, in a case where the surface of the fixing roller 30 is intentionally heated by the planar heat-generating member 42, the planar hear-generating member 42 may be arranged so as to get in touch with the outer surface of the fixing roller 30.

In the case where the planar heat-generating member 42 is in contact with the fixing roller 30, it is preferable that (i) fluororesin coating is applied onto a resistive heat-generating layer of the planar heat-generating member 42, (ii) the fixing roller 30 is coated with a fluororesin tube so that a surface layer of the fixing roller 30 is formed thereon, or (iii) both of (i) and (ii) are carried out. This facilitates smooth driving of the fixing roller 30, which slides on the inner surface of the planar heat-generating member 42.

Third Embodiment

Figure 6:
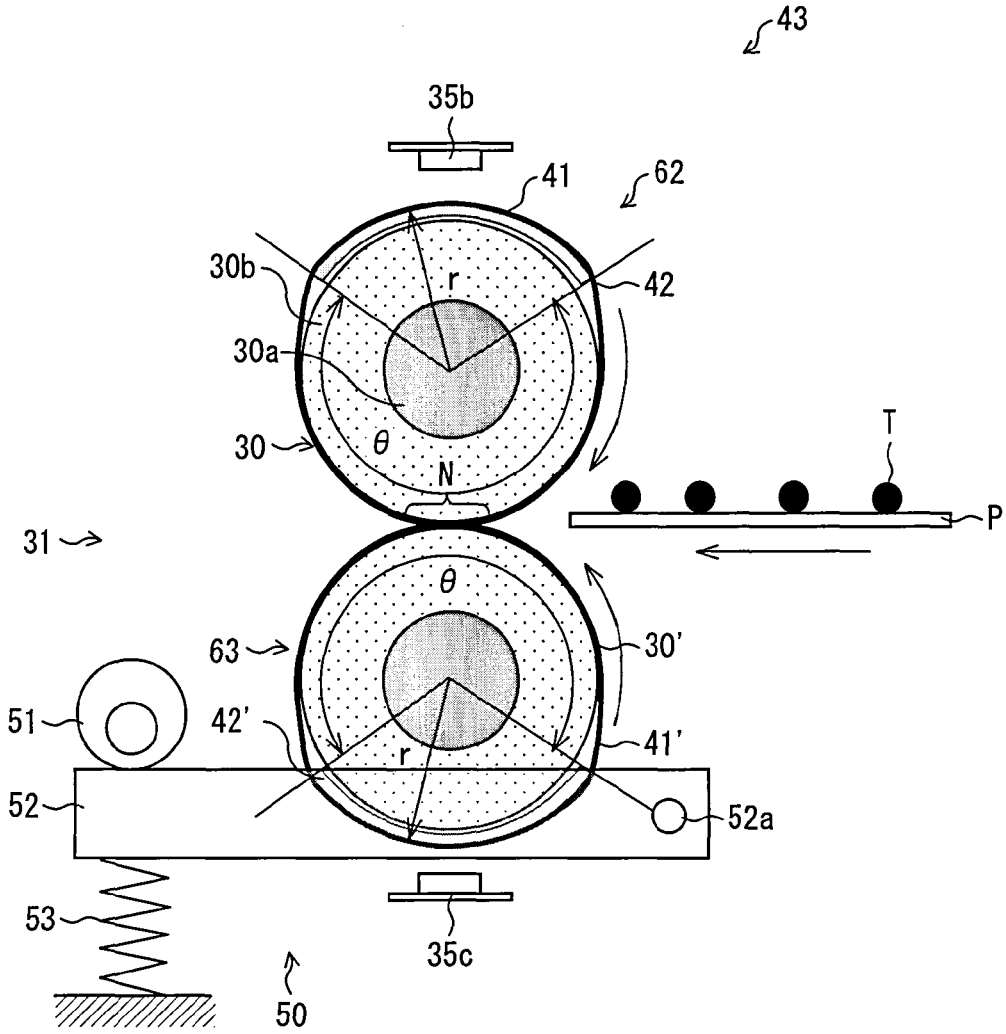
FIG. 6 illustrates further another embodiment of the present invention, and is a partial cross-section view schematically illustrating an arrangement of a fixing unit included in a color multifunction peripheral, as viewed in the axial direction.

The following describes, with reference to FIG. 6, further another embodiment of the present invention. A fixing unit 43 of Third Embodiment has the same structure as that of the fixing unit 40 of Second Embodiment. However, the fixing unit 43 is different from the fixing unit 40 in the way that the fixing unit 43 includes a pressure section 63 having the same structure as that of the fixing section 62, instead of the fixing section 61 including the pressure roller 31 and the heater lamp 34. Therefore, for convenience of description, members having the same functions as those explained in First Embodiment and Second Embodiment are given the same signs as First Embodiment and Second Embodiment, and descriptions thereof are omitted here. Further, the description of the same structure as that explained in First Embodiment and Second Embodiment is omitted here.

The pressure section 63 in the fixing unit 43 of Third Embodiment has the same structure as that of the fixing section 62. That is, the pressure section 63 includes: a pressure roller 30' corresponding to the fixing roller 30; a pressure belt 41' corresponding to the fixing belt 41; and a planar heat-generating member 42' corresponding to the planar heat-generating member 42. The pressure roller 30' presses a fixing roller 30 by using force applied by extension of a pressure spring 53.

In other words, the fixing unit 43 includes two fixing sections 62, so as to have a vertically symmetric arrangement. Further, a fixing roller 30 included in one of the two fixing sections 62 presses a fixing roller 30 included in the other one of the two fixing sections 62. A thermistor 35*c*, which detects a temperature of the pressure roller 30', is the non-contact type, as well as a thermistor 35*a*.

In a fixing device using a conventional planar heat-generating belt type fixing method, a fixing belt easily slips. Therefore, the belt arrangement is adopted to only either one of a fixing section or a pressure section. In the arrangement of the present invention, however, a fixing belt is subjected to a small sliding load and therefore does not easily slip. Therefore, as in Third Embodiment, it is possible to adopt the belt arrangement to both of the fixing section and the pressure section.

As such, adopting the belt arrangement to the pressure section 63 as well as to the fixing section 62 further reduces the short warm-up time, which is an advantage of the planar heat-generating belt type fixing method, thereby further saving energy and increasing a processing speed.

Further, in the fixing unit 43 of Third Embodiment, (i) pressure applied by the pressure roller 30' is released and (ii) the pressure roller 30' of the pressure section 63 is rotated together with the fixing roller 30 of the fixing section 62, during a stand-by mode. Thereby, the pressure roller 30' is also pre-heated.

As described above, during the stand-by mode, not only the fixing roller 30 but also the pressure roller 30' is pre-heated. This further reduces a degree of undershooting which occurs when printing operation is started immediately after the stand-by more, thereby further shortening the FCOT (First Copy Output Time).

In Third Embodiment, as well as in Second Embodiment, the planar heat-generating member 42 has an arc shape having a curvature radius r of 16.5 mm. Further, the planar heat-generating member 42 has a width h of 29 mm, which is smaller than a diameter of the fixing roller 30. Furthermore, the planar heat-generating member 42 is provided in the vicinity of an outer surface of an upper part of the fixing roller 30, while maintaining a gap of 0.5 mm between the planar heat-generating member 42 and the outer surface of the upper part of the fixing roller 30. As well as the planar heat-generating member 42, the planar heat-generating member 42' has an arc shape having a curvature radius r of 16.5 mm. Further, the planar heat-generating member 42' has a width h of 29 mm, which is smaller than a diameter of the fixing roller 30', which has the same structure as that of the fixing roller 30. Furthermore, the planar heat-generating member 42' is provided in the vicinity of an outer surface of a lower part of the fixing roller 30', while maintaining a gap of 0.5 mm between the planar heat-generating member 42' and the outer surface of the lower part of the fixing roller 30'.

Further, the pressure roller 30' has the same structure as that of the fixing roller 30 of First Embodiment; and the pressure belt 41' has the same structure as that of the fixing belt 41 of Second Embodiment.

EXAMPLES

Comparative Example

Figure 7:
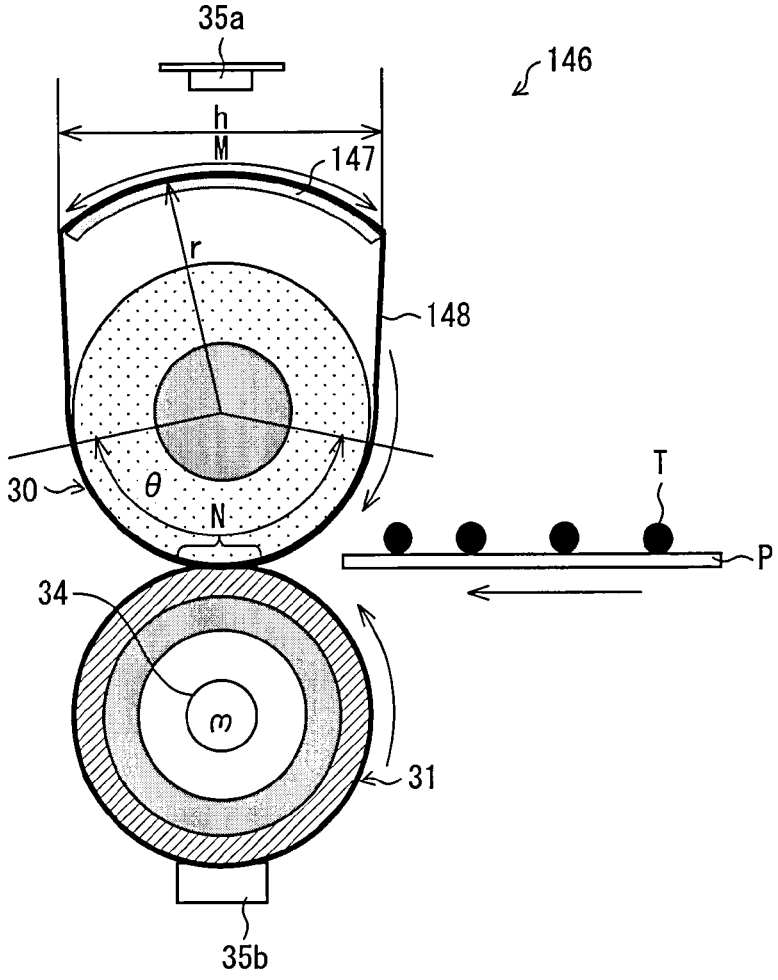
FIG. 7 illustrates a comparative example, and is a partial cross-section view schematically illustrating an arrangement of a fixing unit included in a conventional planar heat-generating belt type fixing method, as viewed in the axial direction.

The following describes a fixing unit 146 of Comparative Example. FIG. 7 illustrates a planar heat-generating belt type fixing device having a conventional arrangement, i.e., the fixing unit 146 of Comparative Example. Although the fixing unit 146 of Comparative Example and the fixing unit 15 of First Embodiment (illustrated in FIG. 1) are different from each other in arrangements of a planar heat-generating member 147 and a fixing belt 148, the fixing unit 146 have the same structure as that of the fixing unit 15 except for them. Therefore, members having the same functions as those explained in First Embodiment are given the same signs as First Embodiment, and descriptions thereof are omitted here.

As illustrated in FIG. 7, the planar heat-generating member 147 of Comparative Example has an arc shape so that the planar heat-generating member 147 and a fixing roller 30 are concentric, when viewed in an axial direction. A curvature radius r of the arc shape is 25 mm. Further, the planar heat-generating member 147 has a width h of 31 mm, which is larger than a diameter of the fixing roller 30. Furthermore, the planar heat-generating member 147 is provided above the fixing roller 30, while maintaining a gap of 9 mm between the planar heat-generating member 147 and the fixing roller 30. Moreover, a contact width M (i.e., a heating nip width), in which the planar heat-generating member 147 of Comparative Example is in contact with the fixing belt 148, is 36 mm. Except for these points (the shape viewed in the axial direction, the width h, and the contact width M), the planar heat-generating member 147 has the same structure as that of the planar heat-generating member 33 of First Embodiment.

The fixing belt 148 has basically the same structure as that of the fixing belt 32 of First Embodiment. However, the fixing belt 148 is different from the fixing belt 148 in the following points: (i) a diameter of the fixing belt 148 is 40 mm, which is larger than that of the fixing belt 32; and (ii) a winding angle θ indicating how much the fixing belt 148 is in contact with the fixing roller 30 is 170°.

[Test 1]

Figure 8:
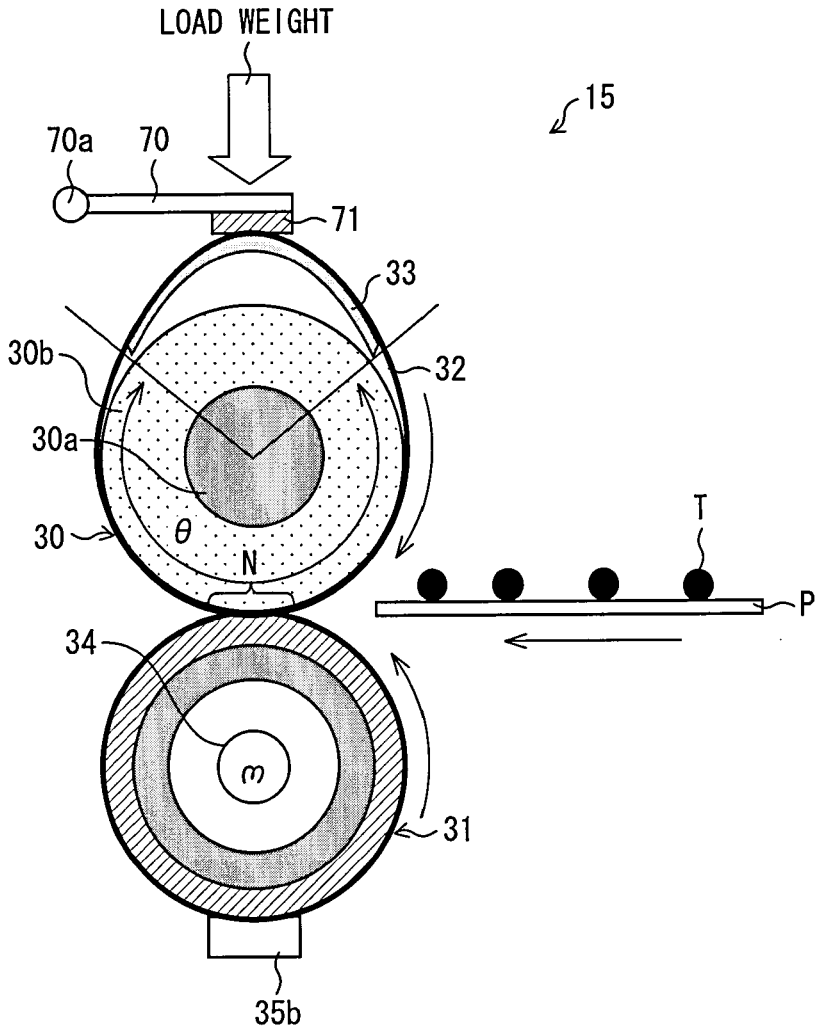
FIG. 8 is an explanatory view of a test method for evaluating belt running performance.

A test for evaluating belt running performance was carried out with respect to fixing units of First Embodiment, Second Embodiment, Third Embodiment, and Comparative Example. A method of carrying out the test is described with reference to FIG. 8. FIG. 8 illustrates a state where the test is being carried out with respect to a fixing unit 15 of First Embodiment.

The method of carrying out the test is as follows. As illustrated in FIG. 8, a brake pad 71 was pressed onto an upper surface of a fixing unit 32 at a predetermined load weight, the fixing unit 15 was rotated, and a load weight at which the fixing unit 32 started slipping was detected. The brake pad 71 was made of silicon sponge rubber, and was attached to a bottom surface of a plate 70, which was supported rotatably around a rotational axis 70*a*. The load weight was applied to the fixing belt 32 by a counter weight placed on a top surface of the plate 70, and the load weight was increased by 1 N.

Table 1 shows the test result:

TABLE 1

| | | Comparative Example | First Embodiment | Second Embodiment | Third Embodiment |
|---|---|---|---|---|---|
| Fixing Roller | Diameter | 30 mm | ← | ← | ← |
| | Shaft | Iron, Diameter: 15 mm | ← | ← | ← |
| | Elastic Layer | Silicon Sponge Rubber, 5 mm | ← | ← | ← |
| Fixing Belt | Diameter | 40 mm | 33 mm | 31 mm | 31 mm |
| | Substrate | Polyimide, 70 μm | ← | ← | ← |
| | Elastic Layer | Silicon Rubber, 150 μm | ← | ← | ← |
| | Surface Layer | PFA Tube, 30 μm | ← | ← | ← |
| | Winding Angle θ | 170° | 260° | 260° | 260° |
| Planar Heat-Generating Member | Shape | Arc (Curvature Radius: 25 mm) | Bullet-Nose Shape | Arc (Curvature Radius: 16.5 mm) | Arc (Curvature Radius: 16.5 mm) |
| | Width h | 31 mm | 20 mm | 29 mm | 29 mm |
| | Heating Nip Width M | 36 mm | 36 mm | 26 mm | 26 mm |
| | Heating Layer | SUS (Thickness: 15 μm) | ← | ← | ← |
| | Insulator Layer | PI (Thickness: 30 μm) | ← | ← | ← |
| | Substrate | Aluminum (Thickness: 1 mm) | ← | ← | ← |
| | Coating Layer | PTFE (Thickness: 20 μm) | ← | ← | ← |
| Pressure Roller | Diameter | 30 mm | ← | ← | The same as fixing roller |
| | Shaft | Iron, Thickness: 2 mm | ← | ← | |
| | Elastic Layer | Silicon Rubber, 3 mm | ← | ← | |
| | Surface Layer | PFA Tube, 30 μm | ← | ← | |

TABLE 1-continued

| | | Comparative Example | First Embodiment | Second Embodiment | Third Embodiment |
|---|---|---|---|---|---|
| Fixing Nip Width N | | 7 mm | ← | ← | ← |
| Heater Power | During Warm-Up | Upper: 1000 W | ← | ← | ← |
| | During Sheet Feeding | Upper: 800 W, Lower: 200 W | ← | ← | ← |
| Fixing Temperature | | 190° C. | ← | ← | ← |
| Belt Running Performance | | Bad (1 N) | Satisfactory (4 N) | Good (8 N) | Satisfactory (4 N) |
| Warm-Up Time | | 20.7 sec. | 18.8 sec. | 15.1 sec. | 13.6 sec. |
| Temperature Response | | −10 deg. | −10 deg. | 0 deg. | 0 deg. |

As shown in Table 1, a fixing belt slips at a load weight of 1 N in Comparative Example. On the other hand, a load weight at which a fixing belt starts slipping is 4 N in First Embodiment and Third Embodiment, and 8 N in Second Embodiment. This shows that First Embodiment, Second Embodiment, and Third Embodiment are more excellent in the belt running performance than Comparative Example.

This is because of the following reasons. Each of the fixing belts of First Embodiment, Second Embodiment, and Third Embodiment is suspended in a more natural form when viewed in the axial direction, compared with the fixing belt of Comparative Example. This allows each of the fixing belts of First Embodiment, Second Embodiment, and Third Embodiment to be subjected to a less load. Further, each of the fixing belts of First Embodiment, Second Embodiment, and Third Embodiment has a larger winding angle, compared with the fixing belt of Comparative Example. This allows the fixing rollers of First Embodiment, Second Embodiment, and Third Embodiment to secure sufficient driving forces for driving the fixing belts, respectively.

It is preferable that a fixing belt is formed in a substantially circular shape when viewed in an axial direction, as in Second Embodiment and Third Embodiment. This is because such a shape allows the fixing belt to reduce as much as possible a load applied to the fixing belt. However, slippage is more prone to occur in Third Embodiment than in Second Embodiment. This is because both of the upper section and the lower section adopt the belt arrangement in Third Embodiment, whereas either one of the upper section or the lower section adopts the belt arrangement and the other section adopts the roller arrangement in Second Embodiment.

[Test 2]

Next, a test for evaluating a fixing property (warm-up time and temperature response) was carried out with respect to fixing units of First Embodiment, Second Embodiment, Third Embodiment, and Comparative Example.

A method of carrying out the test is as follows. Firstly, during a warm-up mode, electric power was supplied at full power only to a planar heat-generating member (with a rated power of 1000 W), which was a heating member, and warm-up operation was carried out in such a state that a fixing roller was rotated (a processing speed: 220 mm/s) from the start. Then, time taken until a temperature of the fixing roller reached a control temperature of 190° C. was measured.

Subsequently, immediately after the warm-up operation was completed, phase control was carried out so that (i) the electric power applied to the planar heat-generating member was changed to 800 W and (ii) electric power applied to a heater lamp in a pressure roller was changed to 200 W. Then, 30 sheets each of which had a basis weight of 80 g/m$^2$ and a size of A4 were fed through the fixing roller at a speed of 50 sheets/min. by means of long edge feeding. During this, the temperature response of the fixing roller was measured. The temperature response was evaluated by measuring how much the temperature of the fixing roller undershoots from the control temperature of 190° C. during the sheet feeding.

The test result thus obtained is indicated in above Table 1. As shown in Table 1, the warm-up time is 20.7 seconds in Comparative Example. On the other hand, the warm-up time is 18.8 seconds in First Embodiment, and 15.1 seconds in Second Embodiment. That is, the warm-up time is shortened in First Embodiment and Second Embodiment, compared with that in Comparative Example. This is because of the following reasons. In Comparative Example, (1) the inner surface of the fixing belt has an area exposed to atmosphere, and this leads to heat loss caused by heat dissipation from the area to the air; and (2) the fixing roller and the planar heat-generating member have a large gap therebetween, and this leads to heat loss caused by heat dissipation from a bottom surface of the planar heat-generating member to the air. With regard to this point, in First Embodiment and Second Embodiment, the inner surface of the fixing belt has a small area (10% or less) exposed to atmosphere, and a gap between the fixing roller and the planar heat-generating member is small. This reduces heat loss caused by heat radiation from the fixing belt and the planar heat-generating member to the air.

Further, in Third Embodiment, the warm-up time is 13.6 seconds, which is further shorter than the warm-up time of Second Embodiment. This is because of the following reason: The pressure section of Third Embodiment, in which the belt arrangement is adopted to the pressure section as well as to the fixing section, has a smaller heat capacity than the pressure section of Second Embodiment.

Furthermore, Table 1 shows the following result regarding the temperature response. In Comparative Example and First Embodiment, while the 30 sheets are passing through a fixing roller, a temperature of the fixing roller drops by 10 deg. from the control temperature of 190° C., that is, the temperature of the fixing roller drops to 180° C. On the other hand, in Second Embodiment and Third Embodiment, no drop in temperature (0 deg.) is detected, and the control temperature of 190° C. is maintained. This shows that Second Embodiment and Third Embodiment are excellent in the temperature response.

This is because of the following reason. In Comparative Example and First Embodiment, a most part of the planar heat-generating member is provided so as to be far from the fixing roller. Therefore, in Comparative Example and First Embodiment, the fixing roller is not so much heated directly by the planar heat-generating member, but is indirectly heated via the fixing belt. As a result, even after the warm-up operation is completed, the fixing roller is not sufficiently warmed up. Therefore, when a sheet-passing mode is started, the heat of the fixing roller is dissipated to the fixing roller, and thereby the temperature of the fixing roller is dropped.

On the other hand, in Second Embodiment and Third Embodiment, the whole of the planar heat-generating member is provided so as to be in the vicinity of the fixing roller. This allows the fixing roller to be heated directly by the planar heat-generating member. Therefore, when the warm-up operation is completed, the fixing roller is sufficiently warmed up. This makes it possible to secure the temperature response.

The present invention is not limited to the description of the embodiments above, but may be altered by a skilled person within the scope of the claims. An embodiment based on a proper combination of technical means disclosed in different embodiments is encompassed in the technical scope of the present invention.

As described above, a fixing device according to the present invention includes: (i) a fixing section including a fixing roller; a heating member which is curved and is made out of a planar heat-generating body; and a fixing belt which is endless and is wound around an outer surface of the fixing roller and an outer surface of the heating member; and (ii) a pressure section, provided so as to face the fixing roller in the fixing section via the fixing belt, for pressing the fixing roller, the heating member being arranged so that at least both ends of the heating member are in the vicinity of or in contact with the outer surface of the fixing roller, said both ends being in a circumferential direction when viewed in an axial direction of the fixing roller, and the heating member having, in the vicinity of said both ends, shapes formed gently with respect to the outer surface of the fixing roller when it is viewed in the axial direction.

With this arrangement, it is possible to arrange the fixing belt wound around the heating member and the fixing roller so that an almost whole inner surface area of the fixing belt is in contact with the heating member or the fixing roller. This allows the fixing belt to have no area or almost no area exposed to atmosphere. This prevents or reduces as much as possible heat loss caused by heat dissipation to the air from the inner surface of the fixing belt, thereby improving heat efficiency.

Further, the fixing belt is naturally formed, without being distorted at an area where the fixing belt is in contact with the heating member. This reduces a sliding load applied on the fixing belt, thereby suppressing an occurrence of slippage of the fixing belt.

Specifically, in the fixing device according to the present invention, it is most preferable that 100% of the inner surface area of the fixing belt is in contact with the heating member or the fixing roller. However, with the arrangement where at least 80% of the inner surface area of the fixing belt is in contact with the heating member or the fixing roller, it is also possible to enhance the heat efficiency compared with a conventional arrangement.

Further, the fixing device according to the present invention may be arranged so that: the heating member has an arc shape so that the heating member and the fixing roller are concentric, and is provided over the fixing roller; and the fixing belt slides on the heating member while maintaining a substantially circular shape when it is viewed in the axial direction.

According to the arrangement, because the fixing belt is formed in the substantially circular shape, it is possible to efficiently reduce the sliding load applied on the fixing belt, thereby further suppressing the occurrence of the slippage of the fixing belt.

Further, because the whole inner surface area of the heating member is arranged so as to be in the vicinity of the outer surface of the fixing roller, the fixing roller is much more heated directly by the heating member, not via the fixing belt.

Furthermore, the fixing device according to the present invention may preferably arranged such that the heating member has a width smaller than the fixing roller when it is viewed in the axial direction.

According to the arrangement, the fixing belt is wound around the fixing roller at a winding angle of 180° or more. This makes it possible for the fixing roller to secure a sufficient driving force for driving the fixing belt, thereby efficiently suppressing the occurrence of the slippage of the fixing belt.

The fixing device according to the present invention may further include a pressure release mechanism for releasing pressure applied by the pressure section, wherein: (i) the pressure release mechanism releases the pressure applied by the pressure section and (ii) the fixing roller is rotated so as to be pre-heated by heat generated by the heating member, during a stand-by state.

According to the arrangement, the fixing roller is rotated even during the stand-by mode so that the fixing roller is pre-heated uniformly by the heat generated by the heating member. Therefore, even in a case where printing operation is started immediately after the stand-by mode, it is possible to prevent the heat of the fixing belt from being rapidly taken away by the fixing roller, thereby preventing an increase in a degree of undershooting. This makes it possible to shorten FCOT (First Copy Output Time).

Further, because the fixing roller is rotated after the pressure applied by the pressure section is released, the fixing belt is not rotated in conjunction with the rotation of the fixing roller. This avoids such a problem that a life of the fixing belt is shortened because of sliding between the fixing belt and members such as the heating member and a temperature sensor.

Further, the fixing device according to the present invention may be arranged such that: the pressure section has the same structure as that of the fixing section, said pressure section including: a pressure roller corresponding to the fixing roller; a pressure belt corresponding to the fixing belt; and a pressure-section-side heating member corresponding to the heating member.

In a fixing device using a conventional planar heat-generating belt type fixing method, a fixing belt easily slips. Therefore, the belt arrangement is adopted to only either one of a fixing section or a pressure section. In the arrangement of the present invention, however, a fixing belt is subjected to a small sliding load and therefore does not easily slip. Therefore, it is possible for both of the fixing section and the pressure section to adopt the belt arrangement. This further reduces the short warm-up time, which is an advantage of the planar heat-generating belt type fixing method, thereby further saving energy and increasing a processing speed.

Further, in the case where the belt arrangement is adopted to the pressure section as well as to the fixing section, the fixing device may preferably be arranged such that: the pressure roller and the fixing roller are rotated so as to be pre-heated by the heat generated by the heating member, during the stand-by state.

With this, not only the fixing roller but also the pressure roller is pre-heated by the heat generated by the heating member during the stand-by mode. This further reduces the degree of the undershooting which occurs when the printing operation is started immediately after the stand-by mode, thereby further reducing the FCOT (First Copy Output Time).

Moreover, the present invention encompasses an image forming apparatus including the above-mentioned fixing device according to the present invention.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. A fixing device, comprising:

a fixing section including a fixing roller; a planar heat-generating body which is curved; and a fixing belt which is endless and is wound around an outer surface of the fixing roller and an outer surface of the planar heat-generating body; and a pressure section, provided so as to face the fixing roller in the fixing section via the fixing belt, for pressing the fixing roller, the planar heat-generating body being arranged so that at least both ends of the planar heat-generating body are in contact with the outer surface of the fixing roller, said both ends being in a circumferential direction when viewed in an axial direction of the fixing roller, the planar heat-generating body having, in the vicinity of said both ends, shapes formed gently with respect to the outer surface of the fixing roller when it is viewed in the axial direction, and a combination of (i) that part of an inner surface area of the fixing belt which is in contact with the planar heat-generating body and (ii) that part of the inner surface area of the fixing belt which is in contact with the fixing roller being at least 90% of the inner surface area.

2. The fixing device as set forth in claim 1, wherein:

the planar heat-generating body has an arc shape so that the planar heat-generating body and the fixing roller are concentric, and is provided over the fixing roller; and the fixing belt slides on the planar heat-generating body while maintaining a substantially circular shape when it is viewed in the axial direction.

3. The fixing device as set forth in claim 1, wherein:

the planar heat-generating body has a width smaller than the fixing roller when it is viewed in the axial direction.

4. The fixing device as set forth in claim 1, further comprising a pressure release mechanism for releasing pressure applied by the pressure section, wherein:

(i) the pressure release mechanism releases the pressure applied by the pressure section and (ii) the fixing roller is rotated so as to be pre-heated by heat generated by the planar heat-generating body, during a stand-by state.

5. The fixing device as set forth in claim 4, wherein:

the pressure section has a same structure as that of the fixing section, said pressure section including:

a pressure roller corresponding to the fixing roller;

a pressure belt corresponding to the fixing belt; and a pressure-section-side planar heat-generating body corresponding to the planar heat-generating body; and the pressure roller and the fixing roller being rotated so as to be pre-heated by the heat generated by the planar heat-generating body, during the stand-by state.

6. The fixing device as set forth in claim 1, wherein:

the pressure section has a same structure as that of the fixing section, said pressure section including:

a pressure roller corresponding to the fixing roller;

a pressure belt corresponding to the fixing belt; and a pressure-section-side planar heat-generating body corresponding to the planar heat-generating body.

7. The fixing device as set forth in claim 1, wherein the planar heat-generating body is in a bullet-nose shape.

8. An image forming apparatus, comprising a fixing device, said fixing device including:

a fixing section including a fixing roller; a planar heat-generating body which is curved; and a fixing belt which is endless and is wound around an outer surface of the fixing roller and an outer surface of the planar heat-generating body; and a pressure section, provided so as to face the fixing roller in the fixing section via the fixing belt, for pressing the fixing roller, the planar heat-generating body in the fixing device being arranged so that at least both ends of the planar heat-generating body is in contact with the outer surface of the fixing roller, said both ends being in a circumferential direction when viewed in an axial direction of the fixing roller, the planar heat-generating body having, in the vicinity of said both ends, shapes formed gently with respect to the outer surface of the fixing roller when it is viewed in the axial direction, and a combination of (i) that part of an inner surface area of the fixing belt which is in contact with the planar heat-generating body and (ii) that part of the inner surface area of the fixing belt which is in contact with the fixing roller being at least 90% of the inner surface area.

9. The image forming apparatus as set forth in claim 8, wherein:

the fixing device further includes a pressure release mechanism for releasing pressure applied by the pressure section; and (i) the pressure release mechanism releases the pressure applied by the pressure section and (ii) the fixing roller is started to be rotated so as to be pre-heated by heat generated by the planar heat-generating body, during a stand-by mode.

* * * * *